United States Patent [19]

Greenway et al.

[11] 4,407,391

[45] Oct. 4, 1983

[54] POLE CLIMBER'S SAFETY DEVICE

[76] Inventors: Peter R. Greenway, 5105 Mount Nemo Rd., R.R. #2, Milton, Ontario, Canada, L9T 2X6; Andrew C. Sulowski, 6 Sweet Pea Path, Weston, Ontario, Canada, M6P 3S3; Henry C. George, 57 Ambleside Ave., Toronto, Ontario, Canada, M8Z 2H8

[21] Appl. No.: 368,301

[22] Filed: Apr. 14, 1982

[51] Int. Cl.[3] ..... A62B 35/00

[52] U.S. Cl. ..... 182/9; 182/133

[58] Field of Search ..... 182/9, 3, 8, 133, 134, 182/135, 136

[56] References Cited

U.S. PATENT DOCUMENTS

| | | | |
|---|---|---|---|
| 213,715 | 3/1879 | Mengden | 182/9 |
| 869,382 | 10/1907 | Newton | 182/9 |
| 1,036,987 | 8/1912 | Feinen | 182/9 |
| 1,955,473 | 4/1934 | Raymer | 182/9 |
| 2,842,300 | 7/1958 | Johnson | 182/133 |
| 2,879,830 | 3/1959 | Johnson | 182/9 |
| 2,920,714 | 1/1960 | Johnson | 182/9 |
| 3,856,111 | 12/1974 | Baker | 182/135 |
| 4,130,177 | 12/1978 | Pandolph | 182/8 |
| 4,137,995 | 2/1979 | Fonte | 182/135 |
| 4,168,765 | 9/1979 | Ferguson et al. | 182/187 |

*Primary Examiner*—Reinaldo P. Machado

*Attorney, Agent, or Firm*—Ridout & Maybee

[57] ABSTRACT

A pole climber's safety device comprises a closed yoke for encompassing a pole, the yoke providing an attachment plate for attaching a safety belt and handle portions to be grasped by the climber. The yoke is formed by two half yokes hingedly interconnected together and secured by a releasable fastening. Pivoted blades are mounted on the underside of the yoke, and blades being biassed to a pole engaging position and being manually retractable.

11 Claims, 6 Drawing Figures

FIG. 4
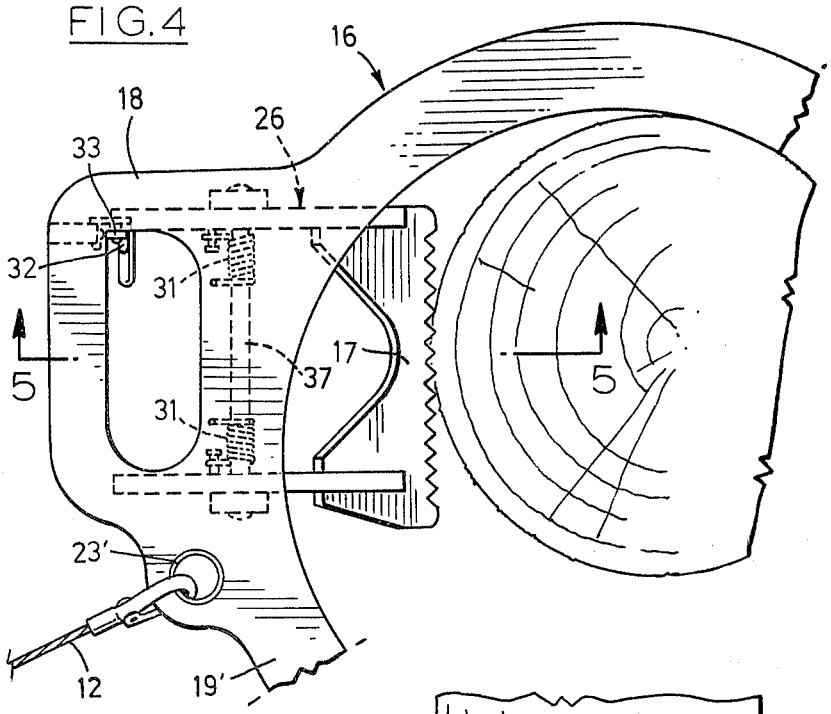
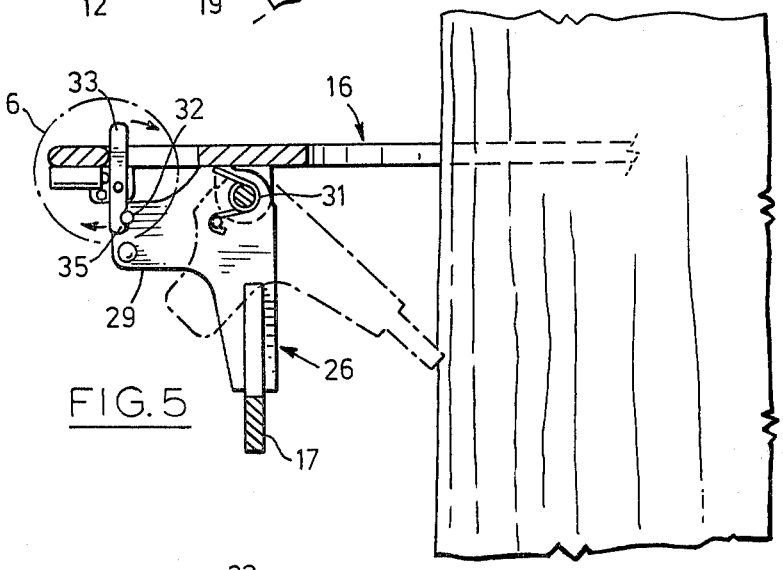
FIG. 5
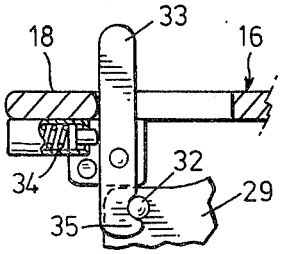
FIG. 6

POLE CLIMBER'S SAFETY DEVICE

FIELD OF THE INVENTION

This invention relates to safety devices for use more particularly by linemen and others who in the course of their work are required to climb poles, such as poles carrying electrical power lines or telephone wires.

BACKGROUND OF THE INVENTION

For climbing such poles linemen normally wear lineman's climbers in conjunction with a lineman's body belt and safety strap. The lineman's climbers have gaffs which penetrate the pole to prevent the feet from slipping and to provide purchase for climbing. The safety strap, which is attached to the body belt, is used for climbing as well as supporting the lineman in his working position on the pole. However, accidents do sometimes occur as a result of the gaffs becoming temporarily disengaged from the poles, and safety devices have been proposed for supporting the weight of a climber in the event that his feet should slip so as to prevent such accidents. The practical usefulness of such safety devices ultimately depends upon the willingness of linemen to use them, which in turn depends upon whether such devices can conveniently be used in the field. In this connection a lineman will normally be reluctant to use a device which appears to be an unnecessary encumbrance.

It is a primary object of the present invention to provide an improved pole climber's safety device which is simple and convenient to use while providing the required degree of safety. The device will also be more than currently used safety straps when used on an iced pole.

SUMMARY OF THE INVENTION

A pole climber's safety device in accordance with the invention comprises a closed yoke for encompassing a pole, the yoke comprising the pair of arcuate half yokes which are hingedly interconnected at one pair of adjacent ends and connected together by releasable fastening means at the other pair of adjacent ends. The half yokes provide handle portions for use by the climber, and means for attaching a safety belt or the like to the yoke. A plurality of blades are pivotally mounted on the lower surfaces of the half yokes, which define the underside of the yoke when the device is in use, the blades being mounted for pivotal movement about respective horizontal pivotal axes and projecting inwardly from the half yokes for biting or gripping engagement with the pole. Means are provided for biasing the blades to the pole engaging position, and manually operable means are provided for retracting the blades from the pole engaging position about their pivotal axes for permitting movement of the device down the pole.

In one embodiment of the invention the blades are gravity biassed by counterweights to the pole engaging position. As the device is moved upwardly along the pole during climbing the pivoted blades ride easily along the surface of the pole, but should the climber's feet slip the resultant pull on the yoke will cause the blades to bite into the surface of the pole, thereby checking any downward movement and so preventing the climber from falling. For descending the climber simply retracts the blades manually so as to disengage them from the pole.

In another embodiment of the invention the blades are spring biassed to the pole engaging position, but can be retracted manually for descent and retained in the retracted position by manually operable latches mounted on the handle portions of the yoke.

BRIEF DESCRIPTION OF THE DRAWINGS

In order that the invention may be readily understood, two embodiments thereof will now be described, by way of example, with reference to the accompanying drawings, in which:

FIG. 4 is a plan view showing a detail of a modified safety device;

FIG. 5 is a section on line 5—5 in FIG. 4; and

FIG. 6 shows on an enlarged scale the detail which is circled in FIG. 5.

DESCRIPTION OF THE PREFERRED EMBODIMENTS

Figure 1:
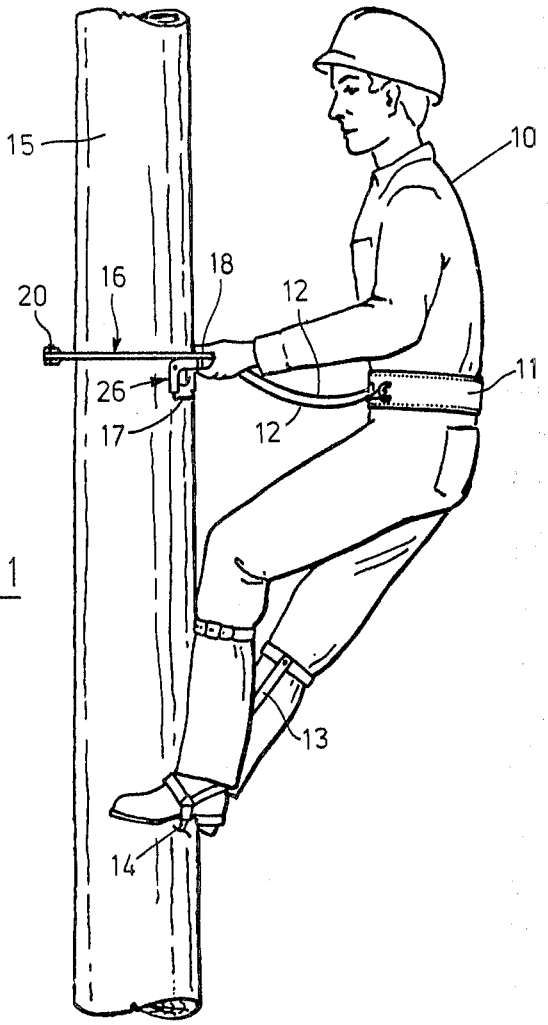
FIG. 1 illustrates the manner in which a safety device in accordance with the invention is used by a lineman.

A pole climbing safety device in accordance with the invention is used in the manner illustrated in FIG. 1. The climber 10 wears a body belt 11 including connectors 12, 12', and on his feet wears pole climbers 13 providing gaffs 14 for engagement with the pole 15. The connector 12 is attached to an annular yoke 16 which encompasses the pole 15, and which carries pivoted blades 17 on its underside for biting engagement with the pole. The blades are mounted adjacent to a pair of handle portions 18, which are held by the climber and as shown in FIG. 1 the climber has retracted the blades from the pole engaging position for descent.

Figure 2:
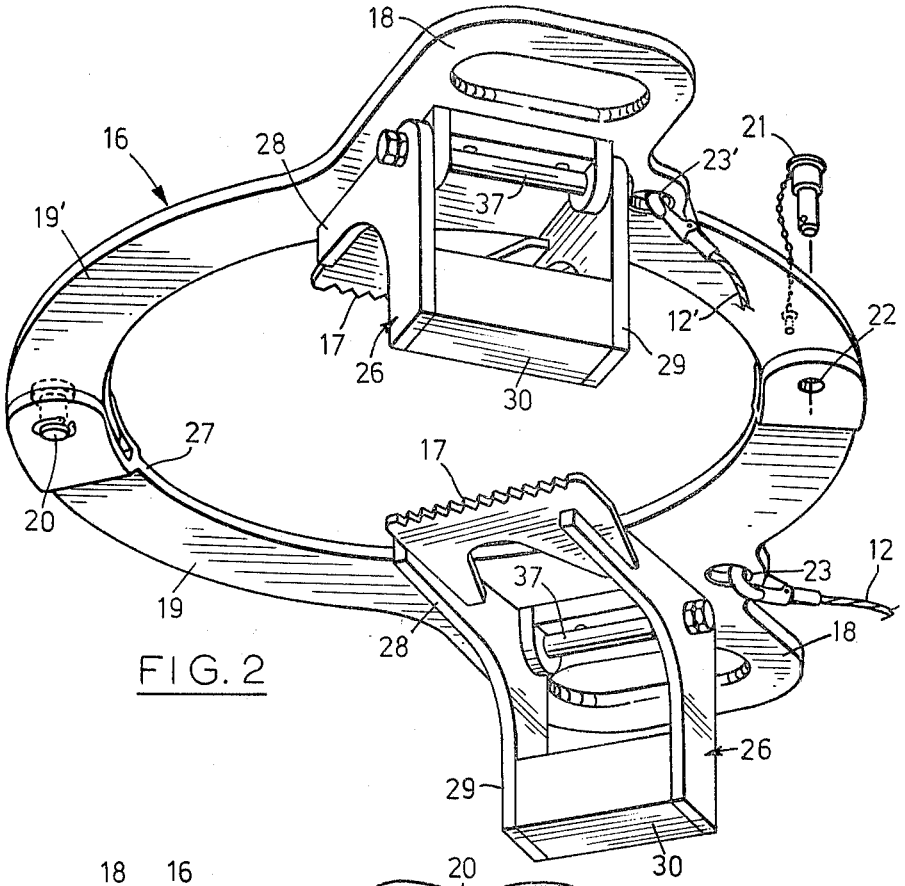
FIG. 2 is a perspective view of a safety device in accordance with one embodiment of the invention.

Referring to FIG. 2, the yoke 16 of FIG. 1 consists of two half yokes 19, 19' of arcuate form, the half yokes being interconnected to form a closed annular yoke structure for encompassing the pole to be climbed. The half yokes provide upper and lower surfaces which, during normal use of the device, define the top and the underside of the yoke 16. The half yokes 19, 19' are interconnected at one pair of adjacent, overlapping ends by a retained pin connection 20, which provides a vertical hinge axis for enabling the yoke to be opened and closed. The other pair of adjacent overlapping ends of the half yokes are interconnected by a quick release pin 21 which engages in a hole 22 in the half yoke 19 so as to provide a releasable fastening between said ends.

The half yokes 19, 19' have holes 23, 23' for the attachment of the connectors 12, 12'.

Each half yoke is formed with an integral radially projecting portion, constituting an outwardly extending handle portion 18, these handle portions being conveniently placed one on either side of the connectors attachment holes 23, 23' so that they can be comfortably grasped by the user.

Figure 3:
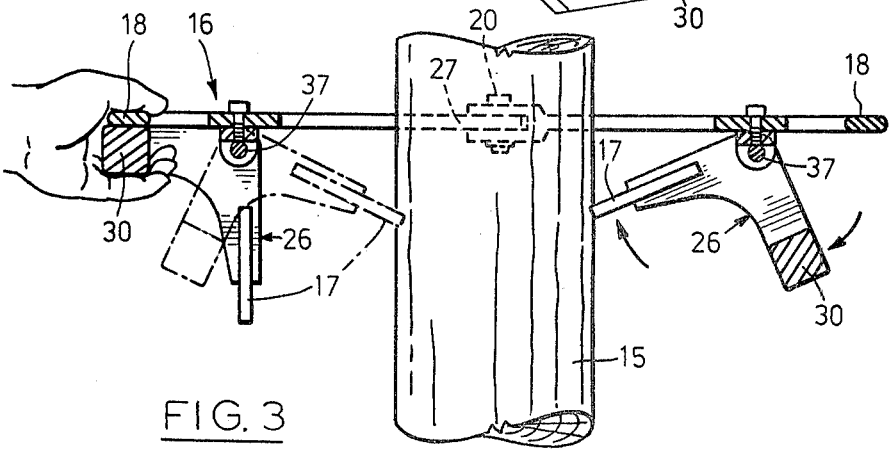
FIG. 3 is a sectional view showing the device of FIG. 2 in use.

The blades 17 are fixedly mounted on rocker frames 26, which are pivotally mounted on pivot pins 37 on the undersides of the handle portions 18. The blades project inwardly from the yoke and in use of the device cooperate with a fixed blade portion 27 formed by the rear inner edge of the yoke 16. The blades 17 are angled with respect to one another and with respect to the blade portion 27 so as to engage the front side of the pole 15, i.e. the side facing the climber, while the blade portion 27 will engage the rear side of the pole. The rocker frames 26 are L-shaped as seen in side elevation, the inwardly projecting pairs of arms 28 thereof carrying the blades 17 and the downwardly depending arms 29 thereof carrying counterweights 30 which bias the pivoted blades about their horizontal pivotal axes to a pole engaging position. The depending arms 29 are conveniently placed so that they can easily be manipulated by the climber while holding on to the handle portions 18 so as to retract the blades from the pole engaging position, as illustrated in FIG. 3.

When ascending the pole, the climber will simply, grasp the handle portions 18 and raise the yoke 16 along the pole, the rocker frames 26 being freely pivotable on the pins 37 so that the blades 17 will ride along the surface of the pole. To descend, the climber simply moves the rocker frames to retract the blades 17 from a pole engaging position. Should the climber lose his footing, his weight will cause the yoke 16 to tilt from the horizontal and the pole will be firmly engaged by the blade portion 27 and blades 17 which will bite into the pole and prevent a fall.

The second embodiment of the invention illustrated in FIGS. 4, 5 and 6 differs from the first embodiment of the invention only in the manner in which the blades 17 are biassed to the pole engaging position. Corresponding parts are denoted by the same reference numerals as are used in the previous figures. As before, the blades 17 are mounted on L-shaped rocker frames 26 for pivotal movement about horizontal axes defined by pivot pins 37, but instead of being gravity biassed they are spring biassed by torsion springs 31. The rocker frames can be manipulated by the climber to retract the blades from the pole engaging position. The depending arms 29 of each rocker frame provide a cross pin 32 for engagement with a manually operable latch 33 mounted on the handle portion 18 of the yoke. This latch takes the form of a pivoted lever biassed by a spring-loaded plunger 34 and having a catch 35 thereon for engagement with the cross pin 32 for retaining the blade 17 in the retracted position when required. The latch 33 is normally biassed to the unlatched position. To use the device the blades 17 are first retracted against the bias of the plungers and held in the retracted position by the latches 33, the latter being held in the latching position by the thumbs of the user. Should the user lose his footing he will release the latches and so release the blades 17 which will thereupon be urged to the pole engaging position. The latches can also be released voluntarily, of course, for releasing the blades so as to anchor the device at a selected position on the pole.

What we claim is:

1. A pole climber's safety device comprising a closed yoke for encompassing a pole, the yoke consisting of a pair of arcuate half yokes providing upper and lower surfaces, the half yokes being hingedly interconnected with respect to a vertical axis at one pair of adjacent ends; releasable fastening means interconnecting the other pair of adjacent ends of said half yokes; attachment means for attaching safety belt connectors to the yoke; a pair of handle portions extending outwardly from the half yokes on either side of said attachment means; a plurality of blades pivotally mounted on the lower surfaces of said half yokes for pivotal movement about respective horizontal pivotal axes, the blades projecting inwardly from the half yokes for biting or gripping engagement with the pole; means biasing the blades about their pivotal axes to a pole engaging position; and manually operable means for retracting the blades in one direction from the pole engaging position about their pivotal axes for permitting movement of the device down the pole.

2. A pole climber's safety device according to claim 1, wherein there are two of said pivoted blades, each mounted on a respective one of said half yokes adjacent the respective one of said handle portions.

3. A pole climber's safety device according to claim 1, wherein the yoke provides an inwardly directed fixed blade portion positioned to engage the rear side of the pole, there being two of said pivoted blades, each mounted on a respective one of said half yokes adjacent the respective one of said handle portions, the blades being angled with respect to one another and said fixed blade portion for engaging the front side of the pole.

4. A pole climber's safety device according to claim 3, wherein each said blade is fixedly mounted on a rocker frame, the rocker frames being pivotally mounted on said lower surfaces of the half yokes for pivotal movement about horizontal pivotal axes.

5. A pole climber's safety device according to claim 4, wherein each rocker frame is weighted for biasing the blade to the pole engaging position.

6. A pole climber's safety device according to claim 5, wherein each rocker frame includes a depending portion carrying a counterweight for pivotally biasing the blade to the pole engaging position, said depending portion being manually engageable for pivotally retracting the blade.

7. A pole climber's safety device according to claim 6, wherein said handle portions are integral with said half yokes, the rocker frames being pivotally mounted on the lower surfaces of the handle portions.

8. A pole climber's safety device according to claim 4, wherein each rocker frame is spring biassed in one direction about its pivotal axis for urging the blade to the pole engaging position.

9. A pole climber's safety device according to claim 8, wherein each of said handle portions carries a manually operable latch, each rocker frame having a latch engaging member positioned to engage the respective latch for retaining the blade mounted on such rocker frame in the retracted position.

10. A pole climber's safety device according to claim 9, wherein the latch comprises a spring-loaded lever having a catch thereon for engagement by the latch engaging member.

11. A pole climber's safety device according to claim 10, wherein said handle portions are integral with said half yokes, the rocker frames being pivotally mounted on the lower surfaces of the handle portions.

* * * * *